United States Patent [19]

Mueller

[11] 4,214,511

[45] Jul. 29, 1980

[54] BREAK-AWAY VENT FOR GRAIN STORAGE BINS

[76] Inventor: Gary E. Mueller, P.O. Box 366, 507 Williams St., Reynolds, Ill. 61279

[21] Appl. No.: 45,462

[22] Filed: Jun. 4, 1979

[51] Int. Cl.[3] ..... F24F 7/00

[52] U.S. Cl. ..... 98/37; 98/114; 55/211; 55/309; 55/493

[58] Field of Search ..... 98/32, 37, 39, 42 R, 98/43 C, 52, 54, 114; 49/7, 8, 463; 55/211, 309, 493

[56] References Cited

U.S. PATENT DOCUMENTS

| | | | |
|---|---|---|---|
| 1,540,788 | 6/1925 | McClure | 98/114 |
| 1,997,204 | 4/1935 | Slocum | 55/309 |
| 2,282,733 | 5/1942 | Malloy | 98/37 |
| 2,821,895 | 2/1958 | Allabaugh | 98/37 |
| 2,849,806 | 9/1958 | Grahek | 34/174 |
| 2,995,079 | 8/1961 | LaFountaine | 98/37 |
| 3,273,327 | 9/1966 | Hoffman | 55/567 |
| 3,287,886 | 11/1966 | Tiberi | 55/378 |
| 3,490,177 | 1/1970 | Perrion | 49/463 |
| 3,509,812 | 5/1970 | James | 98/114 |
| 3,553,942 | 1/1971 | Harrington | 55/483 |
| 3,892,169 | 7/1975 | Jarnot | 98/37 |
| 3,971,897 | 7/1976 | Lee | 55/491 |

*Primary Examiner*—Ronald C. Capossela
*Attorney, Agent, or Firm*—Henderson & Sturm

[57] ABSTRACT

A conventional grain storage bin is equipped with means for ventilation and curing the stored grain by inducing air flow through the grain in response to a pressure differential existing between the interior of the bin and the outside atmosphere. The invention provides a break-away screen at the vent constructed to break away when the pressure differential exceeds a predetermined value, thereby preventing damage to the structure; e.g., collapse of the roof, walls, etc. when the pressure differential is created by a lower pressure inside the bin.

10 Claims, 4 Drawing Figures

BREAK-AWAY VENT FOR GRAIN STORAGE BINS

BRIEF DESCRIPTION OF THE INVENTION

The typical grain storage structure is a bin constructed of sheet metal, cylindrical and having a conical sheet metal roof. The stored grain is supported above the ground on a perforated or mesh floor, or aeration trenches are formed in the concrete base of the bin thus creating a lower plenum chamber beneath the grain. An upper plenum chamber exists between the top of the grain and the bin roof. The roof is provided with one or more vents to atmosphere. A pressure differential exists between the interior of the bin and the atmosphere, created by means as a fan connected to the lower plenum chamber and ventilating air from outside circulates upwardly through the grain to the upper plenum chamber and exits at the vent. In other constructions, the fan creates a vacuum in the lower chamber and the air circulation is the reverse; that is, outside air enters at the vent, circulates downwardly through the grain to the lower chamber and exits via the fan. In both types of systems, the vents are screened to filter out undesirable air-borned material. This is especially important in those systems in which the lower pressure exists within the bin, because the bins are usually located and operated in farm-like areas where fragments of straw, stalks, etc. are normally present and it is undesirable that these be sucked into the grain in the bin, besides which there exist heavier and more solid objects such as birds, wood fragments, etc. In areas of high concentration of such foreign material, the screens frequently become clogged, often to such extent as to preclude substantially free air flow therethrough, the pressure within the bin drops to such a level as to result in damage to the bin, as by inward collapse of wall and/or roof portions.

The basic object of the invention is to eliminate this hazard. This is achieved by mounting the screen in the vent in such manner that it can breakaway before the pressure drop becomes dangerous. A further feature of the invention is the provision of means to prevent complete departure of the released screen from the bin structure. For example, a released screen would be sucked into the grain and would eventually find its way to associated material-handling means, such as unloading augers, causing damage to such equipment.

The screen is of mesh or crossed-element construction and only a few of the elements are extended beyond the marginal edge of the screen and serve as part of the connecting means. These projecting elements are thus relatively weak and thus can break off or pull out of the associated wall portion about the screened opening. This is a simple expedient that avoids high cost and complicated mounting structure. The screen is tethered to the associated wall portion so that it cannot be sucked into the grain and is also readily retrievable for replacement or re-use if not excessively damaged. Even though the released screen loses its filtering function, this is far better than a collapsed bin.

DETAILED DESCRIPTION

Figure 1:
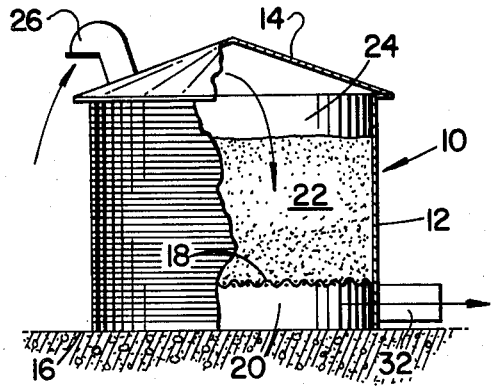
FIG. 1 is a small-scale elevation, with portions broken away, of a typical grain storage structure or bin.
Figure 2:
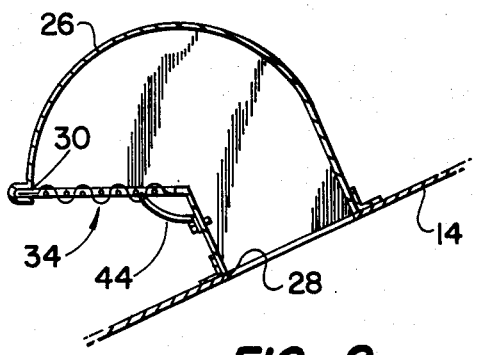
FIG. 2 is an enlarged sectional view of the screen-equipped vent.
Figure 3:
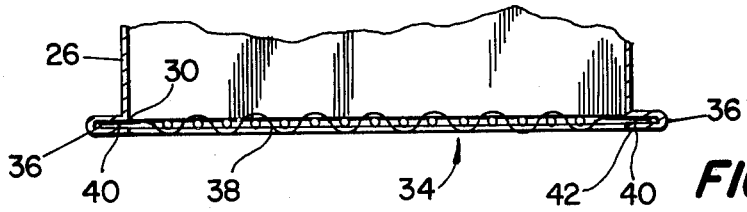
FIG. 3 is a fragmentary sectional view, on a still larger scale, showing a preferred mounting of the screen in the vent opening.

In FIG. 1, the numeral 10 designates a typical storage structure or bin of cylindrical construction as provided by a cylindrical upright wall 12 and a conical roof 14, which may be conventionally of sheet metal. Such bins usually rest upon a concrete or like pad 16 and have means at their lower portions to support the stored grain. In the instant example, such means is shown as a mesh or perforated floor 18 spaced above the pad 16 and providing a lower plenum chamber 20. A quantity of grain is shown at 22, rising to a level below the roof and thus providing an upper plenum chamber 24. The roof is vented by a vent 26 in communication with the upper plenum chamber by an opening 28 (FIG. 2) cut into the roof. The vent is in the form of an elbow facing toward the ground and has an opening 30 (FIGS. 2 and 3). In the present case, the lower plenum chamber is connected to and exhausted by a conventional blower fan (not shown) contained in a housing 32 that opens to outside atmosphere. Thus the pressure within the enclosure afforded by the bin is lower than atmospheric and air is caused to enter at the vent 26 and circulate downwardly through the grain, exiting at the fan housing.

Because of this pressure differential between the interior and exterior of the bin, the basic source of air is that outside the bin and this air is often contaminated by flying particles or foreign material such as referred to before. Consequently, it is conventional to screen the vent to prevent entry of this foreign material. A suitable screen is shown here at 34 but modified as will appear subsequently. Also, as explained before, the screen is apt to become clogged by icing over because of cold, misty conditions outside. In any event, clogging of the screen causes an abnormal pressure drop across the vent opening which could result in damage to the bin, as by collapse of wall or roof portions. As already pointed out, the screen here is capable of release before the pressure drop reaches a dangerous value.

For example, in the present design, it is calculated that a pressure drop having a valve of six inches of vacuum (measured on a conventional manometer) existing during a clogged-vent condition will suck in the roof. Further calculations have established that the screen should release or break away at a value less than that above, preferably in the order of one-quarter to one-half of that and still more preferably at a value of about one-third the aforesaid value.

Figure 4:
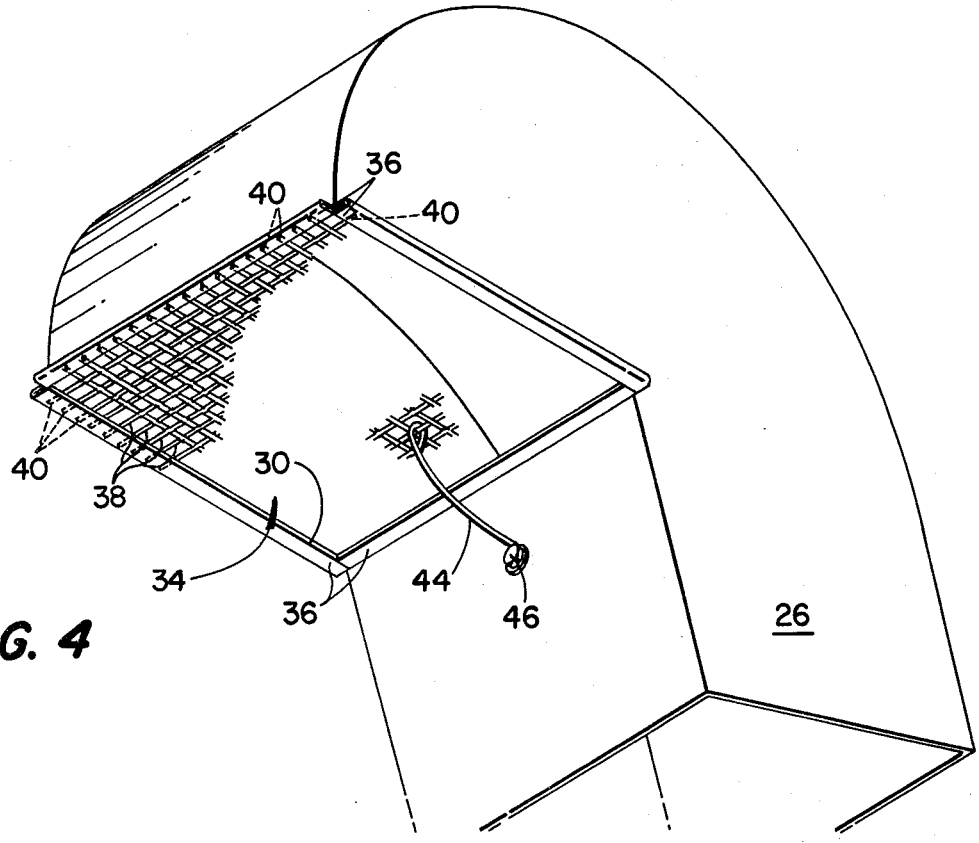
FIG. 4 is a perspective view of the screen of FIG. 3.

As best shown in FIGS. 3 and 4, the vent 26 is provided with marginal flanges 36 that define the opening 30. The arrangement shown here is of rectangular, preferably square, configuration, but other shapes could be used. The screen is constructed of wires or equivalent crossed elements or the like 38, some of which are extended, as tabs 40, beyond the periphery or marginal edges of the screen. In a preferred design, these are provided in pairs at just the four corners of the screen and provide part of the connecting means between the screen and the bin. Related parts of the means are here shown as lips 42 (FIG. 3) on each marginal flange 36. Each lip is a return bend in its flange and thus is an integral part of the flange. When the screen is installed, the projecting wires or tabs 40 are received in the respective flanges and lips and the lips pressed against their associated flanges, gripping the tabs 40 and holding the screen in place for normal operation.

When the screen becomes sufficiently clogged as to cause a pressure drop to a value such as described above, the tabs will release from their flanges. If they all release at once, or substantially at once, the screen will of course be sucked into the grain to be commingled therewith and ultimately find its way into the usual unloading auger, with consequent damage to the auger. To prevent this, the invention provides means preventing complete departure of the released screen from the attaching structure. Such means preferably takes the form of a tether 44 attached to the screen and secured to the vent as by a cap screw 46 (FIG. 4). If fewer than all tabs release, the screen will be partly sucked in and permit increased flow of air sufficient to avoid collapse of parts of the bin. Periodic inspection of the bin will reveal the condition of the screen and this can be corrected easily. Preferably no nuts and bolts are used in connecting the screen. It is far easier to re-insert the tabs of the screen (if not broken off) or to insert the tabs of a new screen by the flanged lip construction shown.

The preferred construction is based on the selection of such parameters as calculated pressure drop, building construction, screen strength and material and the like. Variations in these may dictate modifications that may be readily achieved in the light of the present disclosure.

What is claimed is:

1. In a building structure including an enclosure having a wall provided with an opening and a screen disposed over the opening to afford a vent through which air is caused to flow by the existence of a pressure drop across the vent of a predetermined value resulting from a pressure differential between the interior of the structure and the outside atmosphere, the improvement comprising means for connecting the screen to the wall for holding the screen in place under conditions at pressure drop at and about the aforesaid value, said means being releasable to release the screen from its position across the opening under conditions in which the screen accumulates air-borned and like material to such extent as to cause clogging of the screen sufficient to result in a pressure drop across the vent of a value substantially below the aforesaid predetermined value.

2. The improvement of claim 1, including means for restraining the released screen from departure from the structure.

3. The improvement of claim 1, wherein the screen has peripheral edge portions and the connecting means is connected at fewer than all of said edge portions.

4. The improvement of claim 1, wherein the screen is rectangular and the connecting means is disposed at two opposite edge portions.

5. The improvement of claim 1, wherein the screen is constructed of a plurality of crossed elements and the connecting means includes portions of fewer than all of said elements that project outwardly beyond the periphery of the screen.

6. The improvement of claim 4, including tether means connected between the screen and the structure for retaining the released screen against departure from the structure.

7. The improvement of claim 1, wherein the connecting means will release at a pressure drop in the order of between one-fourth and one-half of the predetermined value.

8. The improvement of claim 1, wherein the connecting means will release at a pressure drop in the order of one-third of the predetermined value.

9. The improvement of claim 1, wherein the screen is rectangular and the connecting means are disposed at the four corners of the screen.

10. The improvement of claim 1, wherein the screen is rectangular and is constructed of a plurality of cross elements, certain of said elements at the four corners of the screen projecting outwardly beyond the periphery of the screen and forming part of the connecting means.

* * * * *